US009472847B2

(12) United States Patent
Lee et al.

(10) Patent No.: US 9,472,847 B2
(45) Date of Patent: Oct. 18, 2016

(54) ANTENNA STRUCTURE AND WIRELESS COMMUNICATION DEVICE EMPLOYING SAME

(71) Applicant: Chiun Mai Communication Systems, Inc., New Taipei (TW)

(72) Inventors: Yi-Chieh Lee, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 110 days.

(21) Appl. No.: 14/066,859

(22) Filed: Oct. 30, 2013

(65) Prior Publication Data

US 2014/0354488 A1 Dec. 4, 2014

(30) Foreign Application Priority Data

Jun. 3, 2013 (TW) ..... 102119655 A

(51) Int. Cl.

| | |
|---|---|
| ***H01Q 5/371*** | (2015.01) |
| ***H01Q 21/30*** | (2006.01) |
| ***H01Q 9/04*** | (2006.01) |
| ***H01Q 9/42*** | (2006.01) |
| ***H01Q 1/24*** | (2006.01) |

(52) U.S. Cl.

CPC ..... *H01Q 5/371* (2015.01); *H01Q 1/243* (2013.01); *H01Q 9/0421* (2013.01); *H01Q 9/42* (2013.01); *H01Q 21/30* (2013.01)

(58) Field of Classification Search

None

See application file for complete search history.

(56) References Cited

U.S. PATENT DOCUMENTS

| | | | | |
|---|---|---|---|---|
| 7,692,595 | B2 * | 4/2010 | Kim | 343/728 |
| 8,497,806 | B2 * | 7/2013 | Lai et al. | 343/702 |
| 2009/0231213 | A1 * | 9/2009 | Ishimiya | 343/702 |
| 2010/0085270 | A1 * | 4/2010 | Lin | 343/859 |
| 2010/0188298 | A1 * | 7/2010 | Suzuki et al. | 343/702 |
| 2012/0212390 | A1 * | 8/2012 | Lan | 343/860 |
| 2013/0050026 | A1 * | 2/2013 | Vin et al. | 343/700 MS |

* cited by examiner

*Primary Examiner* — Robert Karacsony
(74) *Attorney, Agent, or Firm* — Zhigang Ma

(57) ABSTRACT

An antenna structure is electronically connected to a connector of a wireless communication device. The connector includes a power terminal and a ground terminal. The antenna structure includes a main antenna, a secondary antenna, and two posts. The main antenna includes a feed portion and a ground portion. The secondary antenna extends from the main antenna. One post electronically connects the power terminal of the connector to the feed portion, and the other post electronically connects the ground terminal of the connector to the ground portion. A wireless communication device employing the antenna structure is also described.

6 Claims, 5 Drawing Sheets

ANTENNA STRUCTURE AND WIRELESS COMMUNICATION DEVICE EMPLOYING SAME

BACKGROUND

1. Technical Field

The present disclosure relates to an antenna structure and a wireless communication device employing the antenna structure.

2. Description of Related Art

An antenna is used for transceiving wireless signals for a wireless communication device, such as a mobile phone or a personal digital assistant. A space between a circuit board and a frame of a display of the wireless communication device is designated as an antenna clearance zone. However, the available space for the antenna clearance zone is limited because of miniaturization of electronic devices, and a layout and a transmission efficiency of the antenna may be affected. Thus, there are still improvements needed in the art.

BRIEF DESCRIPTION OF THE DRAWINGS

Many aspects of the disclosure can be better understood with reference to the following figures. The components in the figures are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
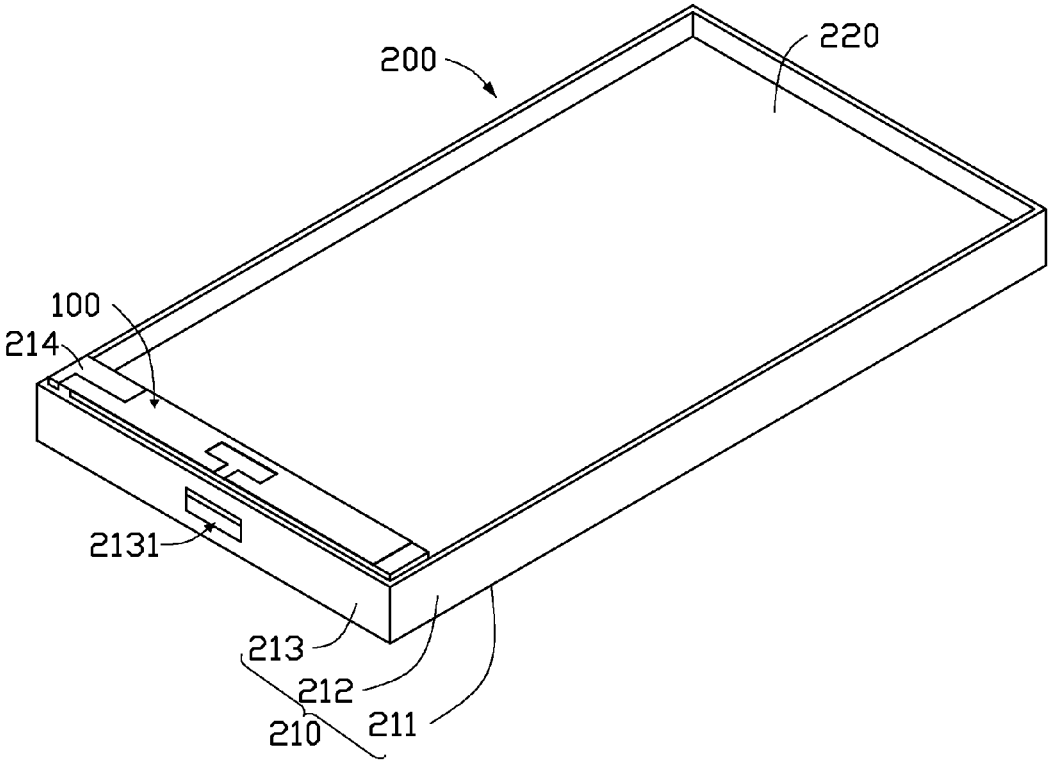
FIG. 1 is an isometric view of an exemplary embodiment of a wireless communication device having an antenna.

Referring to FIG. 1, a wireless communication device 200 has an antenna structure 100, according to an exemplary embodiment. The wireless communication device 200 can be a mobile phone or a tablet computer, for example.

The wireless communication device 200 includes a housing 210, a circuit board 220, and a connector 230. The housing 210 includes a bottom wall 211, two opposite sidewalls 212, and two opposite end walls 213. The sidewalls 212 and the end walls 213 are arranged along peripheral edges of the bottom wall 211. An opening 2131 is defined in one end wall 213 for receiving and exposing the connector 230. The circuit board 220 is mounted in the housing 210. The housing 210 includes a substantially L-shaped carrier 214. The carrier 214 includes a first board 2141 and a second board 2142 connected substantially perpendicularly to the first board 2141. The first board 2141 corresponds to the end wall 213 defining the opening 2131. The second board 2142 is spaced from and parallel with the circuit board 220, thereby defining a clearance zone between the second board 2142 and the circuit board 220. In the exemplary embodiment, the connector 230 is a USB connector mounted on an end of the circuit board 220 and received by the opening 2131. Thus, the connector 230 is exposed from the housing 210. The second board 2142 is adjacent to the connector 230 and is substantially parallel to the bottom wall 211. The connector 230 is electronically connected to the circuit board 220 and includes a power terminal (not shown) and a ground terminal (not shown). The power terminal and the ground terminal serve as a feed portion and a ground portion of the antenna structure 100, respectively, for feeding current and grounding the antenna structure 100.

Figure 2:
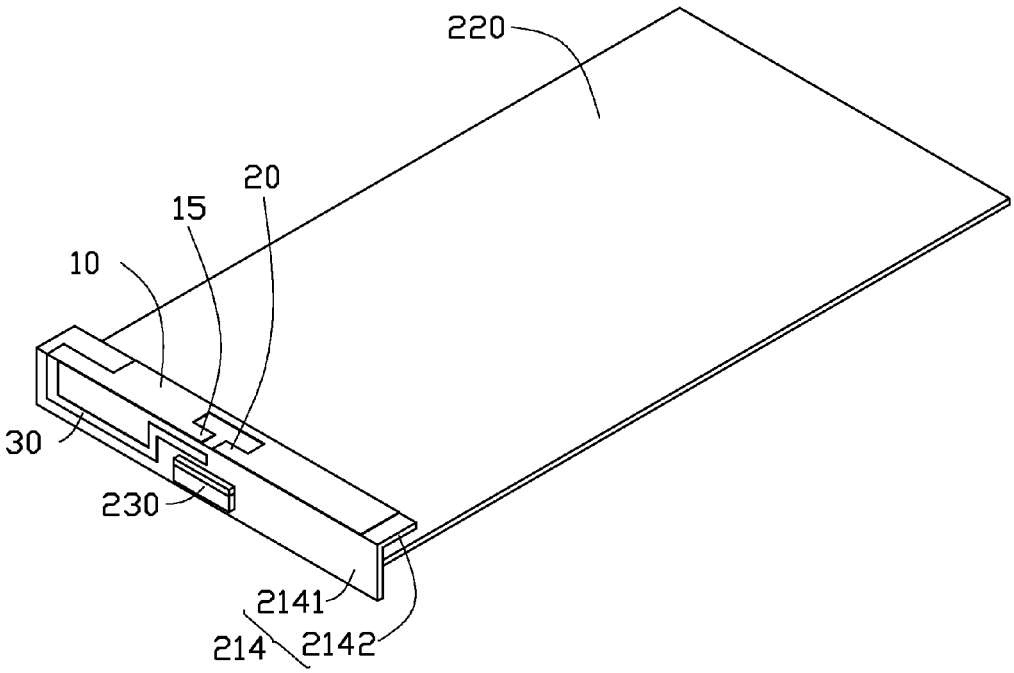
FIG. 2 is an isometric view of the antenna connected to a connector of a circuit board of the wireless communication device of FIG. 1.
Figure 3:
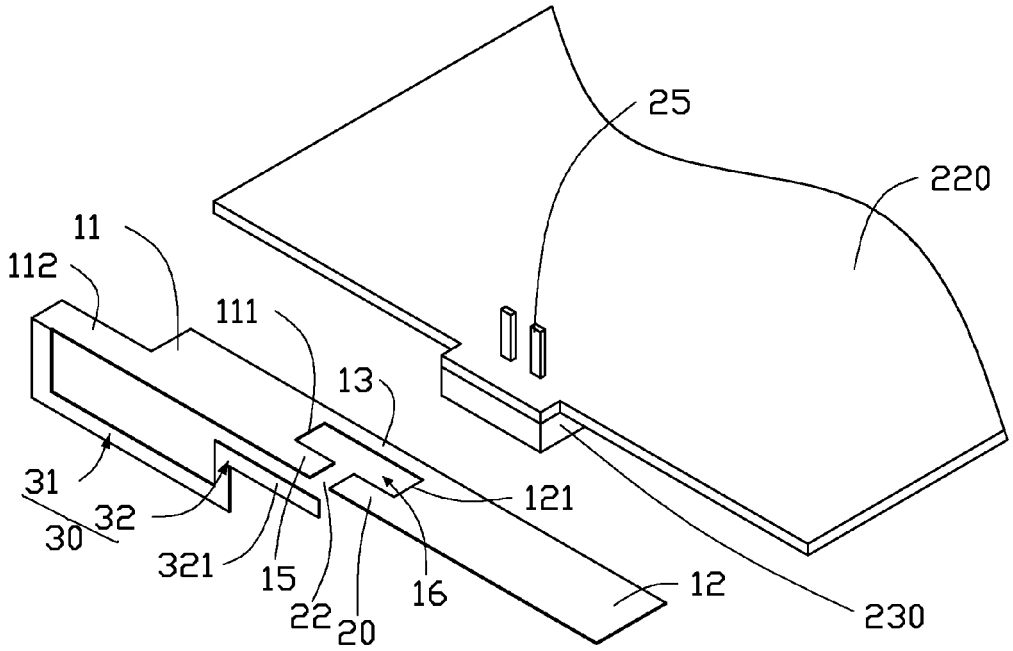
FIG. 3 is an exploded perspective view of the antenna and the circuit board shown in FIG. 2.
Figure 4:
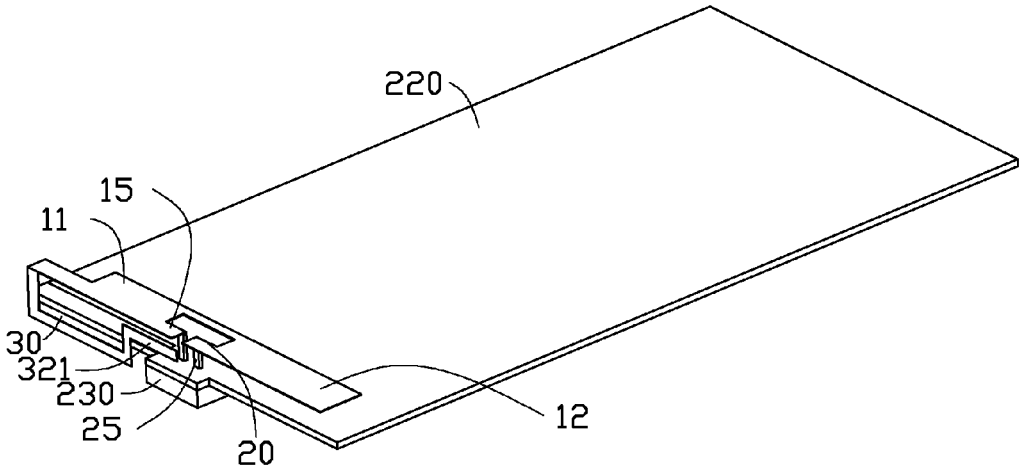
FIG. 4 is a partially assembled perspective view of the antenna and the wireless communication device shown in FIG. 1.

Referring to FIG. 3 and FIG. 4, the antenna structure 100 includes a main antenna 10 (shown in FIG. 2), a feed portion 15, a ground portion 20, two posts 25, and a secondary antenna 30. The main antenna 10 is a planar inverted-F antenna (PIFA), which includes a first sheet 11, a second sheet 12, and a connecting sheet 13. The first sheet 11 is coplanar with the second sheet 12. The first sheet 11 includes a first end 111, and the second sheet 12 includes a second end 121 corresponding to the first end 111.

The feed portion 15 is substantially coplanar with the main antenna 10. The feed portion 15 extends substantially parallel from a side of the first end 111 towards the second end 121 and parallels with the connecting sheet 13. The ground portion 20 extends substantially parallel from a side of the second end 121 towards the first end 111 and parallel with the connecting sheet 13. A gap 22 is defined between the feed portion 15 and the ground portion 20. The feed portion 15, the first end 111, the connecting sheet 13, the second end 121, and the ground portion 20 cooperatively enclose an opening area 16 communicating with the gap 22, thereby forming a high frequency resonance path.

The first sheet 11 further includes a frame 112 extending from an end opposite to the first end 111. The frame 112 is collinear with the feed portion 15. The two posts 25 are made of conductive metal material. One post 25 electronically connects the power terminal of the connector 230 to the feed portion 15 of the main antenna 10, while the other post 25 electronically connects to the ground terminal of the connector 230 to the ground portion 20 of the main antenna 10. Each post 25 penetrates through the second board 2142 to electrically connect to the main antenna 10.

The secondary antenna 30 is a microstrip and includes a first extending portion 31 and a second extending portion 32. The first extending portion 31 is coplanar with the second extending portion 32, and a plane formed by the first extending portion 31 and the second extending portion 32 is perpendicular to a plane of the main antenna 10. The first extending portion 31 is L-shaped and extends perpendicularly from a free end of the frame 112, then bends perpendicularly and extends parallel to the first sheet 11. The second extending portion 32 is L-shaped and extends perpendicularly towards the first sheet 11 from an end portion of the first extending portion 31, then bends perpendicularly and extends parallel to the first sheet 11. The second extending portion 32 includes a free end 321. The free end 321 is spaced from and parallel to the feed portion 15.

The main antenna 10 is supported by the second board 2142. The secondary antenna 30 is supported by the first board 2141. The feed portion 15 and the ground portion 20 are electronically connected to the two posts 25. Current from the power terminal of the connector 230 transmits to the feed portion 15 through the post 25, and then transmits to the first sheet 11, the connecting sheet 13, the second sheet 12, the ground portion 20, the other post 25, and the ground terminal of the connector 230, thus forming a first current path. Therefore, the main antenna 10 can operate at a high frequency resonance mode. The antenna structure 100 receives and transmits wireless signals at a central frequency of about 1700 megaHertz (MHz) to about 2200 MHz. By adjusting sizes and shapes of the first sheet 11, the second sheet 12, the connecting sheet 13, and the opening area 16 during manufacturing, the wireless communication device 200 operates at frequency bands of DCS1800, PCS1900, and WCDMA2100.

In addition, current transmits to the secondary antenna 30 through the first sheet 11 and the second sheet 12, and flows to the ground terminal of the connector 230 through the post 25, thus forming a second current path. Therefore, the main antenna 10 can operates at a low frequency resonance mode. The antenna structure 100 receives and transmits wireless signals at a central frequency of about 800 MHz to about 960 MHz. The central frequency of the low frequency resonance mode of the antenna structure 100 is adjusted by adjusting a size or a shape of the secondary antenna 30, such as by bending.

Figure 5:
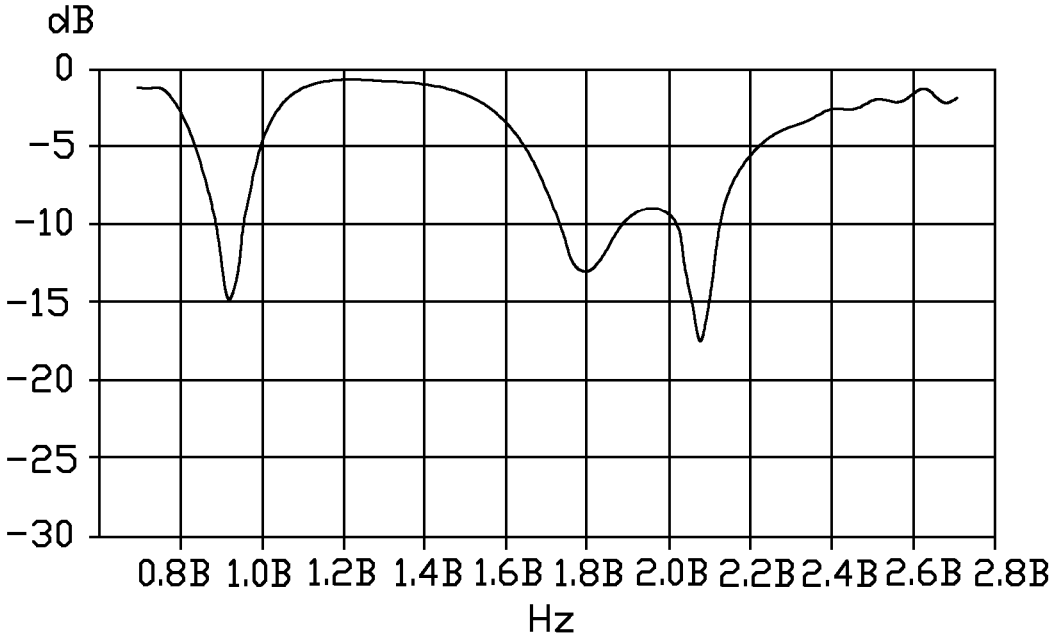
FIG. 5 is a return loss diagram of the antenna of the wireless communication device.

FIG. 5 is a return loss diagram of the antenna structure 100, and shows that the antenna structure 100 is operated at GSM 850, EGSM900, DCS 1800, PCS1900, and WCDMA2100 frequency bands.

The antenna structure 100 defines the opening area 16 in the main antenna 10, and includes the feed portion 15 and the ground portion 20 surrounding the opening area 16. The antenna structure 100 further includes the secondary antenna 30 and the two posts 25 extending from the main antenna 10. The two posts 25 are mounted on the connector 230 of the wireless communication device 200 and are electronically connected to the power terminal and the ground terminal of the connector 230, respectively, thereby reducing a size of the circuit board 220. The secondary antenna 30 and the main antenna 10 resonate at and generate a low frequency resonance mode and a high frequency resonance mode, respectively, to achieve multiple frequencies of the antenna structure 100. The antenna structure 100 is mounted in the clearance zone to improve an operating efficiency thereof. In addition, the antenna structure 100 is simple in structure and receives and transmits multi-frequency band signals.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. An antenna structure, electronically connected to a connector of a wireless communication device, the connector comprising a power terminal and a ground terminal, the antenna structure comprising:

a main antenna comprising a feed portion, a ground portion, a first sheet, a second sheet, and a connecting sheet in a plane, the feed portion connected to the first sheet, the ground portion connected to the second sheet, the connecting sheet connected between the first sheet and the second sheet, the feed portion, the first sheet, the connecting sheet, the second sheet, and the ground portion enclosing an opening area communicating with a gap, the gap defined between the feed portion and the ground portion;

a secondary antenna extending from the first sheet of the main antenna; and two posts, one post electronically connecting the power terminal of the connector to the feed portion, and the other post electronically connecting the ground terminal of the connector to the ground portion;

wherein the main antenna is a planar inverted-F antenna, the secondary antenna includes a first extending portion and a second extending portion coplanar with the first extending portion, a plane of the first extending portion and the second extending portion is perpendicular to a plane of the first sheet and the second sheet;

wherein the first extending portion and the second extending portion both are L-shaped, and connected to each other;

wherein the first sheet includes a junction portion, the first extending portion perpendicularly extends from an end of the junction portion, then bends perpendicularly and extends parallel to the first sheet the second extending portion extends perpendicularly towards the first sheet from an end portion of the first extending portion, then bends perpendicularly and extends parallel to the first sheet;

wherein the first sheet further includes a first end opposite to the junction portion, the second sheet includes a second end, the connecting sheet is connected between a side of the first end and a side of the second end;

wherein the feed portion extends parallel from the side of the first end towards the second end parallel to the connecting sheet, the ground portion extends parallel from the side of the second end towards the first end parallel to the connecting sheet, the feed portion, the first end, the connecting sheet, the second end, and the ground portion enclose the opening area.

2. A wireless communication device, comprising:

a housing;

a connector mounted in the housing and comprising a power terminal and a ground terminal; and an antenna structure mounted in the housing and comprising:

a main antenna comprising a feed portion, a ground portion, a first sheet, a second sheet, and a connecting sheet in a plane, the feed portion connected to the first sheet, the ground portion connected to the second sheet, the connecting sheet connected between the first sheet and the second sheet, the feed portion, the first sheet, the connecting sheet, the second sheet, and the ground portion enclosing an opening area communicating with a gap, the gap defined between the feed portion and the ground portion;

a secondary antenna extending from the first sheet of the main antenna; and two posts, one post electronically connecting the power terminal of the connector to the feed portion, and the other post electronically connecting the ground terminal of the connector to the ground portion;

wherein the main antenna is a planar inverted-F antenna, the secondary antenna includes a first extending portion and a second extending portion coplanar with the first extending portion, a plane of the first extending portion and the second extending portion is perpendicular to a plane of the first sheet and the second sheet;

wherein the first extending portion and the second extending portion both are L-shaped, and are connected to each other;

wherein the first sheet includes a junction portion, the first extending portion perpendicularly extends from an end of the junction portion, then bends perpendicularly and extends parallel to the first sheet the second extending portion extends perpendicularly towards the first sheet from an end portion of the first extending portion, then bends perpendicularly and extends parallel to the first sheet;

wherein the first sheet further includes a first end opposite to the junction portion, the second sheet includes a second end, the connecting sheet is connected between a side of the first end and a side of the second end;

wherein the feed portion extends parallel from the side of the first end towards the second end parallel to the connecting sheet, the ground portion extends parallel from the side of the second end towards the first end parallel to the connecting sheet, the feed portion, the first end, the connecting sheet, the second end, and the ground portion enclose the opening area.

3. The wireless communication device as claimed in claim 2, further comprising a circuit board mounted in the housing, wherein the connector is mounted on an end of the circuit board.

4. The wireless communication device as claimed in claim 3, wherein the housing includes an end wall, the end wall defines an opening, the connector is received in the opening and is exposed from the housing.

5. The wireless communication device as claimed in claim 4, wherein the housing further includes a carrier, the carrier includes a first board and a second board perpendicularly connected to the first board, the second board is parallel with the circuit board, the second board and the circuit board form a clearance zone therebetween, the main antenna is supported by the second board, the secondary antenna is supported by the first board.

6. The wireless communication device as claimed in claim 5, wherein the posts are made of metal conductive material, one end of the posts pass through the second board and electronically connect to the feed portion and the ground portion.

* * * * *